US009708105B2

(12) United States Patent
McPherson

(10) Patent No.: US 9,708,105 B2
(45) Date of Patent: Jul. 18, 2017

(54) TAMPER EVIDENT CLOSURE

(71) Applicant: Obrist Closures Switzerland GmbH, Reinach (CH)

(72) Inventor: Alexander Donald Meiklem McPherson, Falkirk (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 14/784,547

(22) PCT Filed: Apr. 14, 2014

(86) PCT No.: PCT/EP2014/057549

§ 371 (c)(1),
(2) Date: Oct. 14, 2015

(87) PCT Pub. No.: WO2014/170284

PCT Pub. Date: Oct. 23, 2014

(65) Prior Publication Data

US 2016/0068311 A1 Mar. 10, 2016

(30) Foreign Application Priority Data

Apr. 18, 2013 (GB) ..... 1307027.1

(51) Int. Cl.
*B65D 41/34* (2006.01)
*B65D 55/02* (2006.01)

(52) U.S. Cl.
CPC ..... *B65D 41/3447* (2013.01); *B65D 41/34* (2013.01); *B65D 41/348* (2013.01); *B65D 55/026* (2013.01)

(58) Field of Classification Search
CPC ..... B65D 41/3428; B65D 41/3447; B65D 41/3442; B65D 41/34; B65D 41/32;
(Continued)

(56) References Cited

U.S. PATENT DOCUMENTS 2,141,856 A * 12/1938 Fabrice ..... B21D 51/38 24/68 B
2,643,015 A * 6/1953 Soffer ..... B65D 41/48 215/253

(Continued)

FOREIGN PATENT DOCUMENTS

| | | | |
|---|---|---|---|
| GB | 2078689 | A | 1/1982 |
| WO | 9414674 | A1 | 7/1994 |
| WO | 2011064489 | A1 | 6/2011 |

OTHER PUBLICATIONS

Intellectual Property Office of Great Britain, Search Report Issued in Patent Application No. GB1307027.1, Sep. 24, 2013, South Wales, 4 pages.

(Continued)

*Primary Examiner* — Robert J Hicks
(74) *Attorney, Agent, or Firm* — McCoy Russell LLP

(57) ABSTRACT

A tamper-evident closure for a container comprises a shell having a break line along which it is separated during a first opening of the closure. The shell further comprises a first shell portion on one side of the break line, a second shell portion on the other side of the break line, and a distortable portion, which is distorted during the first opening of the closure. The distortable portion is spaced from and separate to the break line.

20 Claims, 4 Drawing Sheets

(58) Field of Classification Search
CPC B65D 41/348; B65D 41/3409; B65D 1/0238; B65D 1/023; B65D 55/026
USPC ..... 215/256, 253, 252, 250, 228, 329, 316, 215/44, 43; 220/266, 268, 265, 212
See application file for complete search history.

(56) References Cited

U.S. PATENT DOCUMENTS

| | | | | | |
|---|---|---|---|---|---|
| 4,352,436 | A * | 10/1982 | Chartier | B65D 41/3452 | 215/252 |
| 4,378,893 | A * | 4/1983 | Wilde | B65D 41/0435 | 215/246 |
| 4,489,841 | A * | 12/1984 | Thompson | B65D 55/026 | 206/459.1 |
| 4,611,723 | A | 9/1986 | Megowen | | |
| 4,905,851 | A * | 3/1990 | Thompson | B65D 55/026 | 215/203 |
| 5,215,204 | A | 6/1993 | Beck et al. | | |
| 2011/0024423 | A1 * | 2/2011 | Erspamer | B65D 41/3428 | 220/266 |

OTHER PUBLICATIONS

ISA European Patent Office, International Search Report and Written Opinion Issued in Application No. PCT/EP2014/057549, Jun. 2, 2014, WIPO, 15 pages.

* cited by examiner

TAMPER EVIDENT CLOSURE

CROSS REFERENCE TO RELATED APPLICATIONS

The present application is a U.S. National Phase of International Patent Application Serial No. PCT/EP2014/057549, entitled "TAMPER EVIDENT CLOSURE," filed on Apr. 14, 2014, which claims priority to Great Britain Patent Application No. 1307027.1, filed on Apr. 18, 2013, the entire contents of each of which are hereby incorporated by reference for all purposes.

FIELD OF THE INVENTION

The present invention relates generally to a tamper-evident closure and particularly to a closure with two or more parts which separate in an opening event and then indicates the closure has been opened at least once.

BACKGROUND OF THE INVENTION

In many cases it is desirable for a closure to provide visible evidence that it has been opened at least once. Many different systems have been proposed for tamper-evidence. One of the most common systems is to ensure that upon first opening the closure separates into two or more parts which are not re-formed upon closing.

One of the main considerations when designing a tamper-evident closure is the prevention of overcoming the tamper-evidence by reforming the closure parts. This is particularly important for products which are subject to counterfeiting, such as in the wines and spirits industry.

It is known, for example, to provide a closure with a generally plain crown and a tubular skirt with a line of weakening which divides the closure into an upper top cap and a lower tamper-evident break band. Upon first opening of the closure the cap and the band are physically separated and upon re-application of the top cap the band remains broken away from the cap. However, it has been found that counterfeiters can re-form such closures by connecting the cap back to the break band using, for example, nail varnish. Such a re-formed cap may be indistinguishable from an untampered closure.

The present invention seeks to address the problems with known tamper-evident closures.

SUMMARY OF THE INVENTION

According to a first aspect there is provided a tamper-evident closure for a container, the closure comprising a shell having a break line along which it is separable, in which the shell further comprises a distortable portion which is distorted upon first opening, the distortable portion being spaced from and separate to the break line.

According to a further aspect there is provided a tamper-evident closure for a container, the closure comprising a shell having a break line along which it is separable, the shell comprising a line of weakness along which it is separated upon first opening of the closure, the shell further comprising a deformable region which is distinct from the break line and is inevitably deformed by axial stretching of the shell during first opening, the closure comprising means for limiting the extent of the axial stretching of the deformable region.

According to another aspect there is provided a tamper-evident closure for a container, the closure including a body having two or more parts which are separated upon first opening along a line of weakness, the opening event causes one or more parts of the body to be distorted, the distortion occurs in a region of the body discrete from the line of weakness.

According to a further aspect there is provided a closure for a container, the closure comprising: an outer shell separable into a first shell portion and a second shell portion, the first shell portion and/or the second shell portion comprising a distortable portion; and an inner part in engagement with the first shell portion, wherein in an opening event, the first shell portion is movable relative to the inner part from an unactivated first position to an activated second position in which there is a predetermined axial movement of the first shell part with respect to the inner part, the opening event causing deformation of the distortable portion, the distortion being limited by the predetermined axial movement of the first shell part with respect to the inner part, the first shell portion and the inner part being arranged to become irreversibly locked in the activated second position so that the first shell portion and the inner part cannot be moved back to the unactivated first position.

The tamper-evidence of the present invention therefore does not rely entirely upon separation of closure shell, but also deformation/distortion of a different part/region so that it is more clear an opening event has occurred and so that returning the closure to its original, unopened state is rendered considerably more difficult.

The distortion may be produced by various methods including stretching, twisting pulling, squashing and tearing. The distortion may affect the integrity of the part and/or its properties including shape, thickness, colour and markings.

The or each body part may be distorted before, during or after breakage and/or separation of the shell. In other words, the distortion may be completed prior to, as part of, or following physical separation.

The distortion may be caused by axial separation of two or more parts (which may, for example be shell sections) for example as the parts are pulled away from each other during opening by having one of the parts captive on a container and the other part moveable.

The distorted part may be adapted to remain on the container in use. Alternatively, the distorted part may be adapted to be removable with undistorted part/s remaining on the container.

The body may include one or more lines of weakness.

The body may comprise a top cap with a tamper evident band at its free end. For example, the body may comprise a shell with a top plate and a depending side wall, with the tamper evident band formed at the free end of the side wall. The free end of such a side wall may be secured to a container neck for example by a tuck-in and/or a tuck-under to secure that part of the body to a container neck.

In embodiments where a tamper-evident band is provided it may be the tamper-evident band which is distorted. Alternatively, or additionally, the top cap of such an arrangement may be distorted.

The distortable region may include a notch line or the like along which distortion occurs in use. The notch line may involve a partial or complete cut through the material of the body. In such cases the arrangement of the distortion line must be such that distortion occurs prior to separation of the parts. This could be done, for example, by selecting an appropriate strength for frangible bridges holding the parts together at a line of weakness.

The body may be formed from any suitable material, for example metal and or plastics material. In some embodiments the closure is of the form of a roll-on pilfer-proof type which is typically formed from aluminium.

Different aspects of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

According to a further aspect of the present invention there is provided a container in combination with a closure as described herein.

BRIEF DESCRIPTION OF THE DRAWINGS

The present invention will now be more particularly described, by way of example, with reference to the accompanying drawings, in which.

DESCRIPTION

Figure 1:
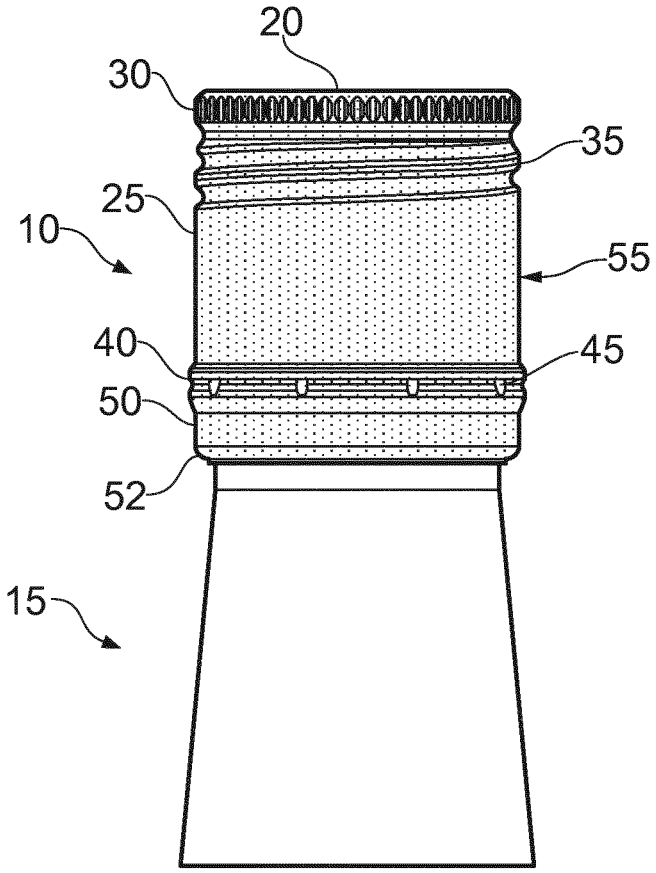
FIG. 1 is a side view of a closure formed according to an embodiment of the present invention shown in a sealed, unopened position.

Referring first to FIG. 1 there is shown a tamper-evident closure generally indicated 10 attached to a container (in this embodiment a bottle) neck 15.

The closure 10 comprises a generally circular top plate 20 having a generally cylindrical side wall 25 depending from its periphery.

The side wall 25 includes a knurled zone 30 adjacent the top plate 20. Adjacent the knurled zone 30 a screw thread profile 35 is provided and corresponds to screw thread formations formed on the neck 15; the profile 35 is formed by rolling the side wall 25 on to the neck 15.

Towards the open end of the side wall 25 a line of weakness 40 is formed by a plurality of frangible bridges 45. On one side the line 40 defines a tamper-evident band 50 the free end of which is turned under a bead (not shown) on the neck 15 at a tuck under 52. At the other side of the line 40 a top cap 55 is defined.

Referring now to FIGS. 2A to 2D the closure 10 is shown during opening.

Figure 3A:
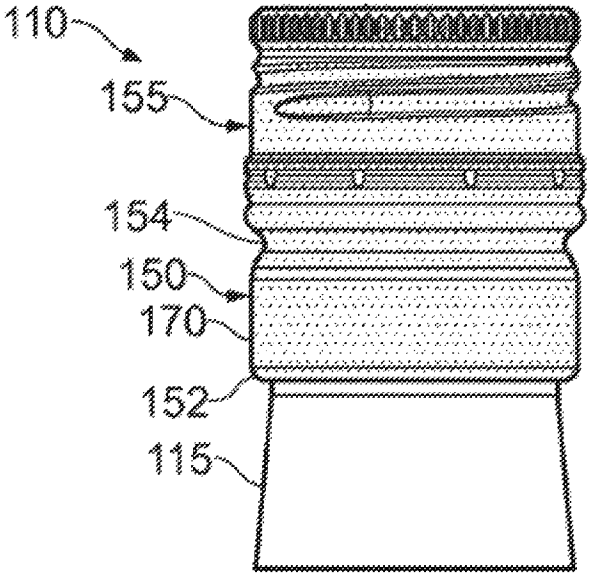
FIG. 3A is a side view of a closure formed according to an alternative embodiment and shown in an unopened condition.

The top cap 55 is turned and the screw thread profile 35 begins to rise up the screw thread formations 36 on the neck (see FIG. 3A). The band 50 is prevented from lifting by the tuck under 52.

The band 50 has a distortion zone 70 formed within it. More specifically, the frangible bridges 45 are not directly connected to the distortion zone 70 but rather a solid intermediate band 80 connects the bridges 45 to the distortion zone 70.

Figure 2D:
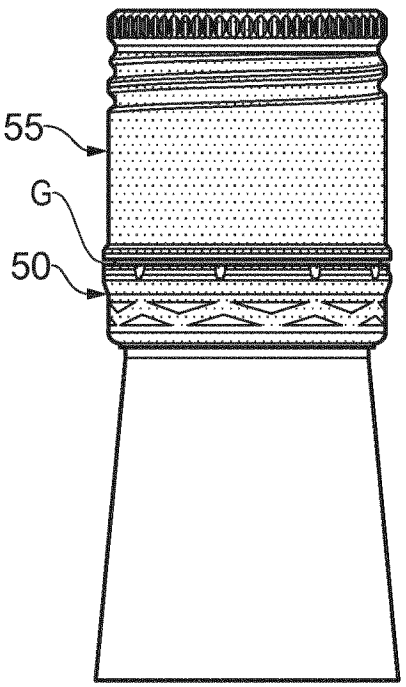
FIGS. 2A to 2D show the opening sequence of the closure of FIG. 1.
Figure 2C:
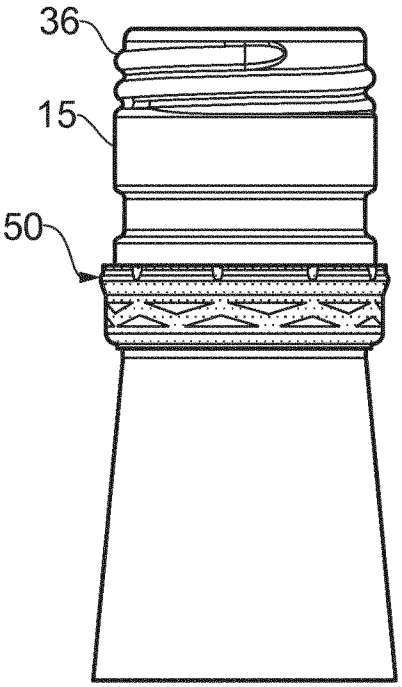
Figure 2B:
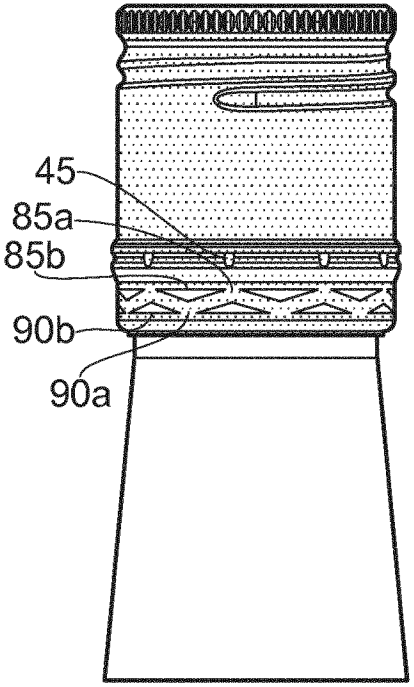
Figure 2A:
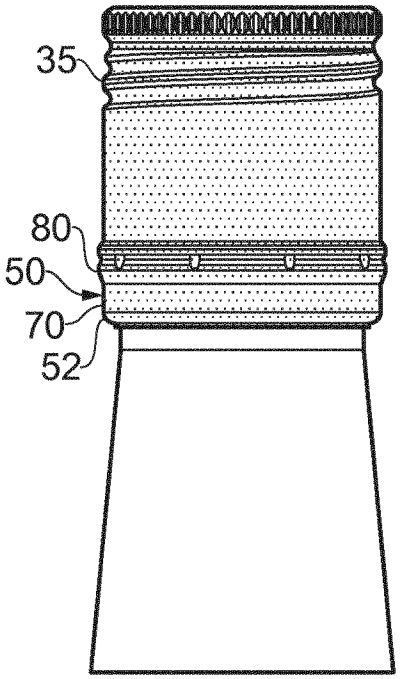

As shown best in FIG. 2B, the distortion zone 70 comprises a hidden notch line with alternating upper and lower slots 85*b*, 90*b* which are defined by respective alternating upper and lower fixed points 85*a*, 90*a*, with the upper fixed points 85*a* connected to the solid band 80 and the lower fixed points 90*a* connected to the tuck under 52.

Upon opening, the distortion band 70 is pulled and stretched into a zig-zag shape shown in FIG. 2B. The bridges 45 then break and the top cap 55 is removed and the distorted band 50 drops down, as shown in FIG. 2C. The band 50 remains on the glass finish. Upon re-application of the top cap 55 the zig-zag distorted area 70 remains as visual evidence the closure has been opened at least once, as shown in FIG. 2D, with a gap G between the top cap 55 and the drop band 50 and the distorted band itself.

Figure 4A:
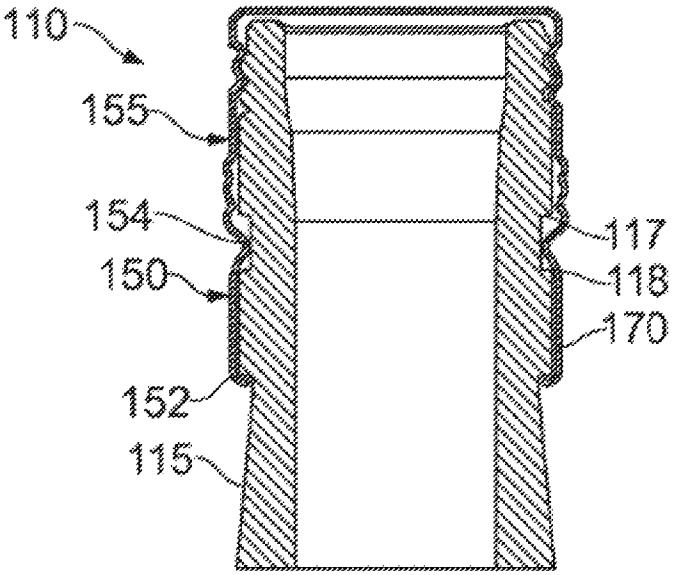
FIG. 4A is a section of the closure of FIG. 3A.

Referring now to FIGS. 3A and 4A there is shown a closure 110 formed according to an alternative embodiment.

The closure 110 is quite similar to the closure 10, with a top cap 155 and drop band 50 part forming an outer shell (in this embodiment formed from metal). The band 50 is longer and includes an insulating bead 154 below the break line 140 and above the distortion zone 170.

The insulating bead is rolled into the shell so as to be spaced from an undercut 117 formed on the neck finish 115. The finish 115 also includes a step 118 below the undercut 117.

Referring now also to FIGS. 3B to 3E and 4B to 4E, when the closure 110 is first opened the tuck under 152 prevents any axial movement of the band. The band 150 is stretched against the tuck under 152 until the insulating bead 154 engages the undercut 117. Accordingly, the notched distortion zone 170 is stretched to the position shown in FIGS. 3C and 4C.

Continued turning of the top cap 155 now causes the main bridges 145 to break. The top cap 155 can now be screwed off and the band 150 drops down, as shown in FIGS. 3D and 4D, until the bead 154 rests on the step 118.

Figure 3E:
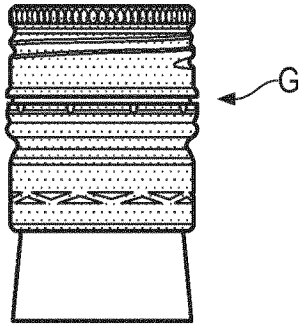
FIGS. 3B to 3E show the opening sequence of the closure of FIG. 3A.
Figure 3D:
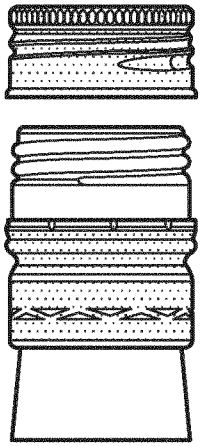
Figure 3C:
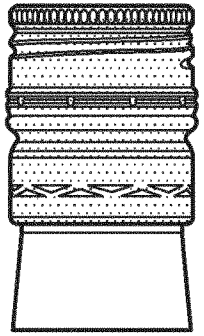
Figure 3B:
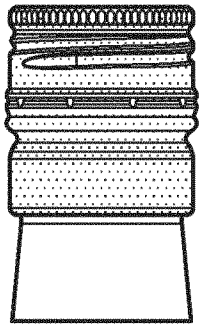
Figure 4E:
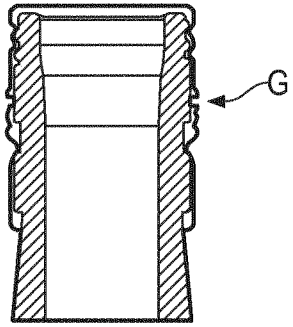
FIGS. 4B to 4E show the opening sequence in sectional form of the closure of FIG. 4A i.e. corresponding to FIGS. 3B to 3E respectively.
Figure 4D:
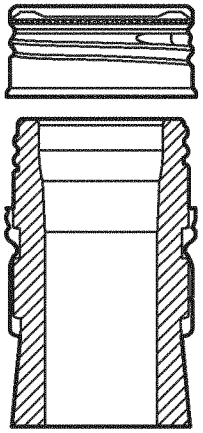
Figure 4C:
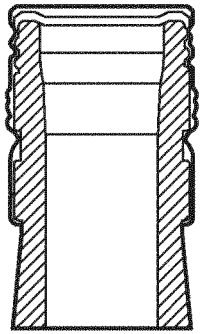
Figure 4B:
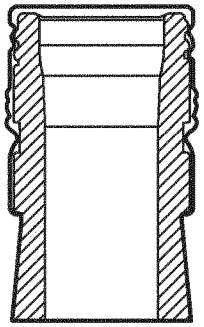

When the top cap 155 is replaced there is a gap G between the cap 155 and the band 150, as shown on FIGS. 3E and 4E.

In other embodiments (not shown) a further gap generating mechanism may be included, for example as described in WO2005/049443.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A tamper-evident closure for a container, the tamper-evident closure comprising a shell having a line of weakness along which the shell is separated during a first opening of the tamper-evident closure, the shell having at least a first shell portion on one side of the line of weakness and at least a second shell portion on the other side of the line of weakness, in which the shell further comprises a distortion zone which is distorted during the first opening of the tamper-evident closure to provide visual evidence that the tamper-evident closure has been opened at least once, the distortion zone being spaced from and separate to the line of weakness, wherein the distortion in the distortion zone is caused by an axial stretching of the shell during the first opening.

2. The tamper-evident closure as claimed in claim 1, in which the tamper-evident closure comprises a means for limiting the extent of the axial stretching of the distortion zone.

3. The tamper-evident closure as claimed in claim 2, in which the means for limiting the extent of the axial stretching of the distortion zone comprises an insulating bead on the shell.

4. The tamper-evident closure as claimed in claim 1, in which the first and second shell portions are connected to each other along the line of weakness by frangible bridges.

5. The tamper-evident closure as claimed in claim 4, wherein a solid intermediate band connects the frangible bridges to the distortion zone.

6. The tamper-evident closure as claimed in claim 1, in which the shell is formed from metal.

7. A container in combination with the tamper-evident closure as claimed in claim 1.

8. The tamper-evident closure as claimed in claim 1, wherein the distortion zone comprises a hidden notch line with alternating upper and lower slots.

9. The tamper-evident closure as claimed in claim 1, in which the distortion is caused in the distortion zone prior to the separation of the shell along the line of weakness.

10. A tamper-evident closure for a container, the tamper-evident closure comprising a shell having a line of weakness along which the shell is separated during a first opening of the tamper-evident closure, the shell having at least a first shell portion on one side of the line of weakness and at least a second shell portion on the other side of the line of weakness, in which the shell further comprises a distortion zone which is distorted during the first opening of the tamper-evident closure to provide visual evidence that the tamper-evident closure has been opened at least once, the distortion zone being spaced from and separate to the line of weakness, in which the shell comprises a top plate and a sidewall depending from the periphery of the top plate, and in which a free end of the sidewall is tucked under a bead on a container neck.

11. The tamper-evident closure as claimed in claim 10, in which the shell is formed from metal.

12. A container in combination with the tamper-evident closure as claimed in claim 10.

13. The tamper-evident closure as claimed in claim 10, in which the distortion is caused in the distortion zone prior to the separation of the shell along the line of weakness.

14. The tamper-evident closure as claimed in claim 10, in which the first and second shell portions are connected to each other along the line of weakness by frangible bridges.

15. A tamper-evident closure for a container, the tamper-evident closure comprising a shell having a line of weakness along which the shell is separated during a first opening of the tamper-evident closure, the shell having at least a first shell portion on one side of the line of weakness and at least a second shell portion on the other side of the line of weakness, in which the shell further comprises a distortion zone which is distorted during the first opening of the tamper-evident closure to provide visual evidence that the tamper-evident closure has been opened at least once, the distortion zone being spaced from and separate to the line of weakness, wherein the shell is separated during the first opening of the tamper-evident closure into a first, removable shell portion and a second, captive shell portion that remains on the container in use, and wherein the distortion zone is formed within the second, captive shell portion.

16. The tamper-evident closure as claimed in claim 15, wherein when the first, removable shell portion is removed and replaced, there is a gap between the first, removable shell portion and the second, captive shell portion.

17. The tamper-evident closure as claimed in claim 15, in which the shell is formed from metal.

18. A container in combination with the tamper-evident closure as claimed in claim 15.

19. The tamper-evident closure as claimed in claim 15, in which the distortion is caused in the distortion zone prior to the separation of the shell along the line of weakness.

20. The tamper-evident closure as claimed in claim 15, in which the first and second shell portions are connected to each other along the line of weakness by frangible bridges.

* * * * *